United States Patent [19]

Sundin

[11] 4,027,580

[45] June 7, 1977

[54] PAD STACKER

[75] Inventor: George Holger Sundin, Duluth, Minn.

[73] Assignee: Conwed Corporation, St. Paul, Minn.

[22] Filed: Nov. 21, 1975

[21] Appl. No.: 634,021

[52] U.S. Cl. ..... 93/93 M; 93/93 R; 93/93 C; 271/69; 271/186

[51] Int. Cl.[2] ..... B31B 1/94

[58] Field of Search ..... 271/69, 82, 186, 187, 271/195; 93/93 C, 93 DP, 93 R, 93 M

[56] References Cited

UNITED STATES PATENTS

| | | | |
|---|---|---|---|
| 323,394 | 8/1885 | Campbell | 271/195 |
| 2,904,334 | 9/1959 | Cundall et al. | 271/69 X |
| 3,075,760 | 1/1963 | Frederick | 271/187 |
| 3,390,619 | 7/1968 | Williams | 93/93 DP |
| 3,712,186 | 1/1973 | Lulie et al. | 93/93 C X |
| 3,830,144 | 8/1974 | Kuckhermann et al. | 93/93 R X |

*Primary Examiner*—James F. Coan
*Attorney, Agent, or Firm*—Eyre, Mann, Lucas & Just

[57] ABSTRACT

A method and apparatus for stacking in precise alignment relatively large, flat, lightweight and flexible objects such as low density felted, fiber pads are disclosed. The disclosed method comprises the steps of feeding the pads towards the stack, rotating the leading edge of a pad to be stacked approximately 180° to place the leading edge of the pad at the top of the stack in a position reversed top-bottom due to the rotation, and causing the remaining portion of the pad to follow in the position reversal along the top of the stack. The disclosed apparatus comprises at least one wheel with clips thereon for receiving and securing the leading edge of the pad, means such as an electric motor for rotating the wheel, means such as a slotted planar guide for disengaging the leading edge of the pad from the at least one wheel in precise alignment at the top of the stack as the at least one wheel rotates through the slots, and means such as air pressure directed against the pad remainder to cause it to take its place along the top of the stack. More than one pad may be stacked simultaneously according to the invention.

33 Claims, 6 Drawing Figures

FIG. 4
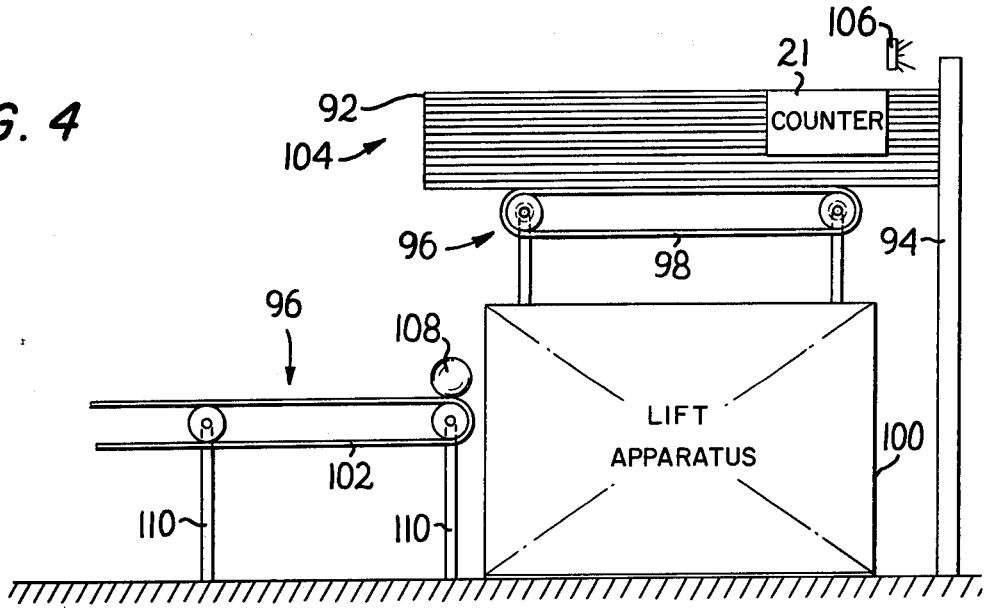
FIG. 5
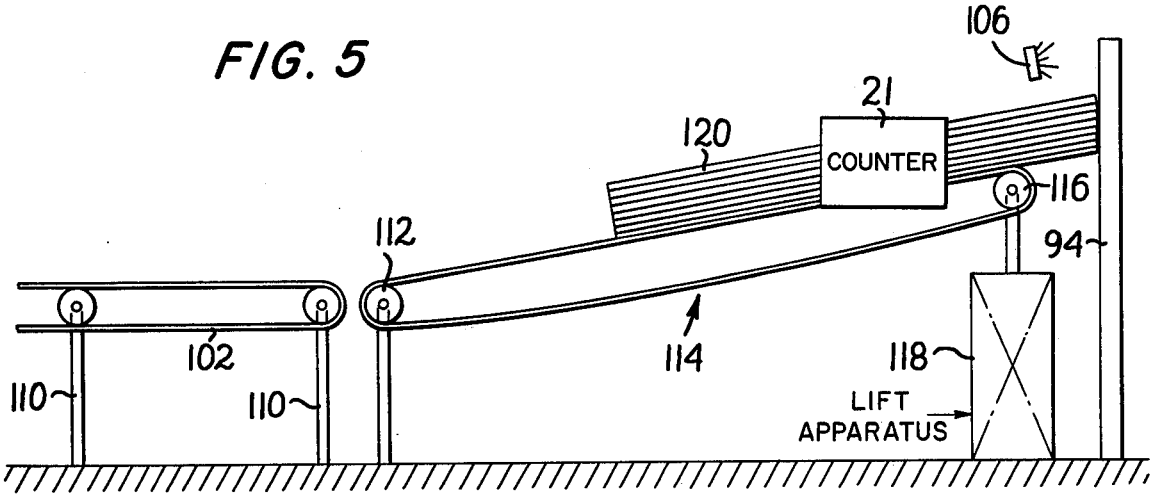
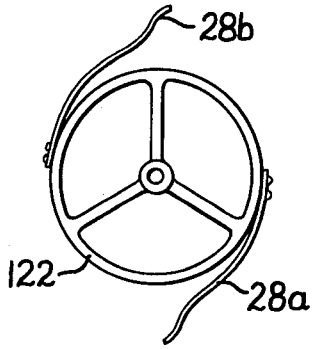
FIG. 6

PAD STACKER

BACKGROUND OF THE INVENTION

1. Field of the Invention

This invention relates to a method and apparatus for stacking large, relatively flat lightweight, flexible objects such as pads of low density, felted, fibrous materials and the like.

2. Description of the Prior Art

Present methods for stacking flexible pads which are relatively large and flat are slow and cumbersome, and when stacking speed is increased a poorly indexed, i.e., imprecisely aligned, stack results. Moreover, skilled personnel are required to oversee the operation of these known methods. The known stacker machines are huge and cumbersome and similarly require skilled personnel for adjustment and proper operation. The stacking speed of the known machines is slow and if the speed is increased the pads become airborne and uncontrollable for precise indexing. The aforementioned drawbacks are obviated and additional advantages realized by the stacking method and apparatus disclosed herein.

SUMMARY OF THE INVENTION

The present invention is embodied in and carried out by a method and apparatus for stacking in at least one stack flexible pads which are relatively large, flat and lightweight. Rotary motion, which is exceptionally smooth, is employed and permits high speed continuous stacking with no speed interruption during a cycle. The method comprises the steps of receiving and securing the leading edge of at least one pad to be stacked above a respective stack near one end thereof, rotating the leading edge of a respective pad approximately 180° reversing the relative positioning of its top and bottom, discharging the respective reverse positioned leading edge at the top of the respective stack indexed at the said one end thereof, and assisting the portion of the respective pad trailing its leading edge to reverse its upper and lower position along and on the respective stack. The apparatus comprises means for receiving and securing the leading edge of at least one pad to be stacked above a respective stack near one end thereof, means for rotating the respective leading edge approximately 180° reversing the relative positioning of its top and bottom, means for discharging the respective reverse-positioned leading edge at the top of a respective stack indexed at the said one end thereof, and means for assisting the portion of the respective pad trailing its leading edge to reverse its upper and lower positions along and on the respective stack. Control means are preferably provided to sense and control the receiving and securing, rotating, and discharging operations, and the synchronization thereof, as well as the position of the top of a respective stack. Means are also preferably provided to count the number of pads being stacked. Means are also preferably provided for moving the pads to be stacked towards the receiving and securing means.

These and other aspects of the present invention will be more apparent from the following detailed description of the invention when considered in conjunction with the accompanying drawing.

BRIEF DESCRIPTION OF THE DRAWING

The invention is illustrated by way of example in the figures of the accompanying drawing which form part of this application and in which like numerals refer to like parts:

FIG. 4 is a side diagrammatic view of a movable stacking system according to the invention;

FIG. 5 is a side diagrammatic view of another movable stacking system according to the invention; and FIG. 6 shows diagrammatically another embodiment of a stacker wheel and clips according to the invention.

DESCRIPTION OF THE PREFERRED EMBODIMENTS

Figure 1:
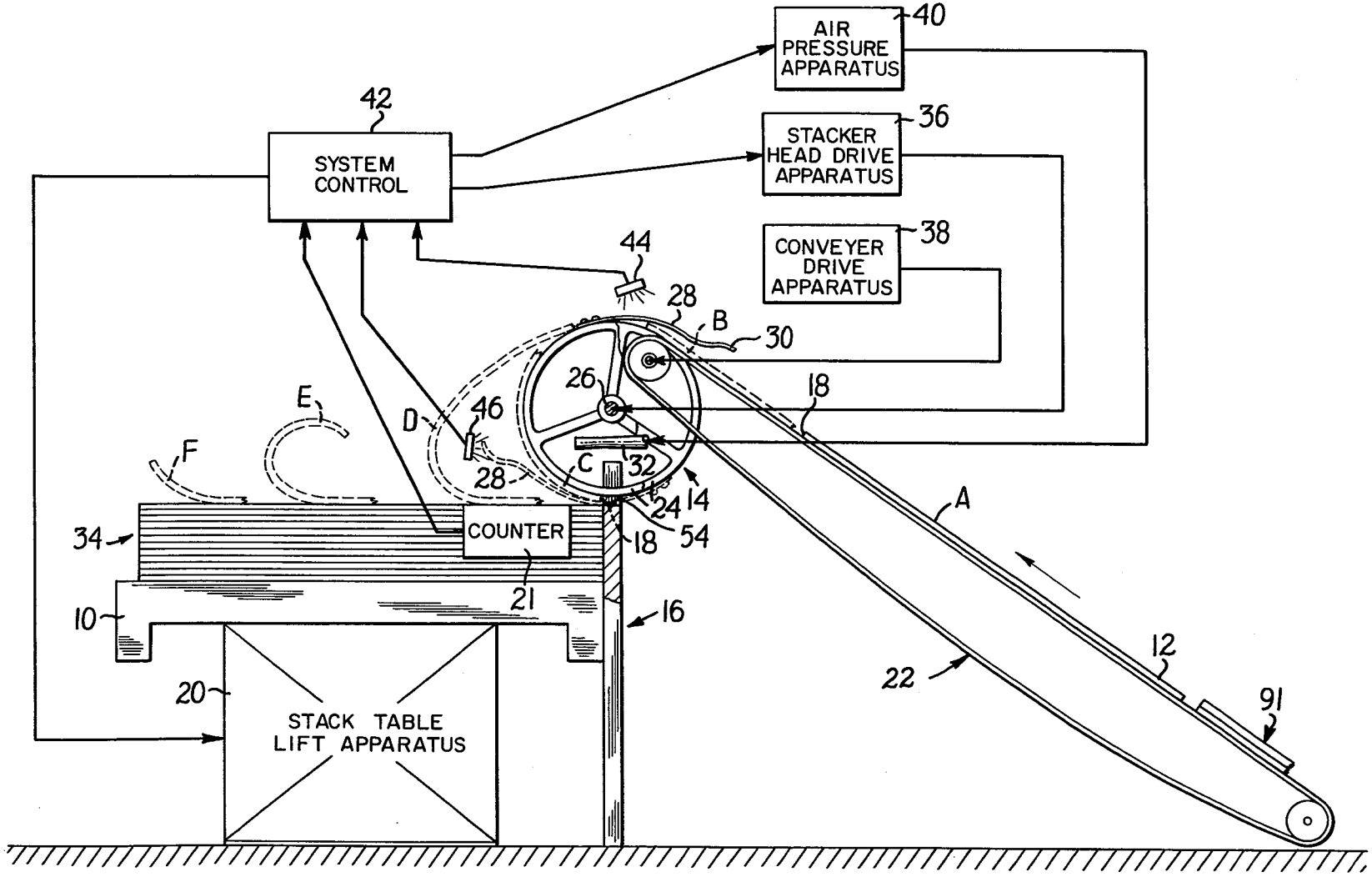
FIG. 1 is a side diagrammatic view of the preferred embodiment of an apparatus according to the invention.
Figure 2:
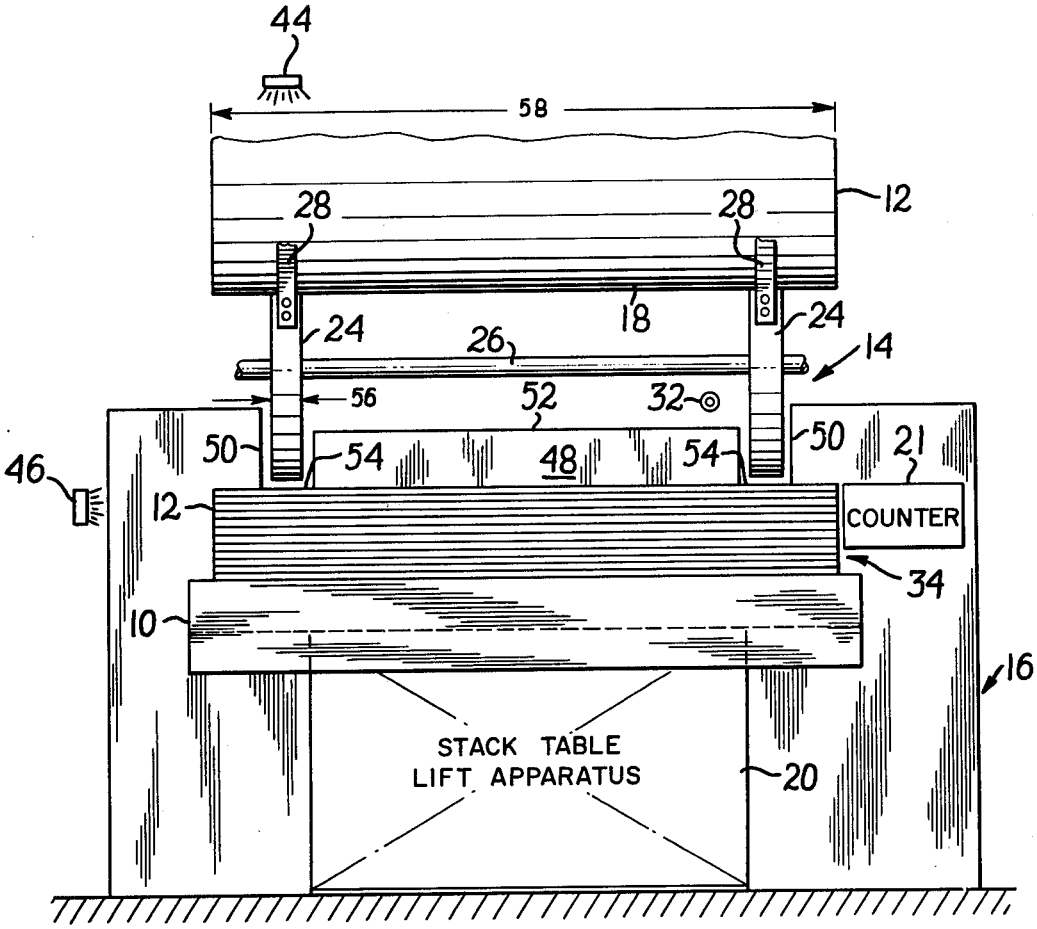
FIG. 2 is a front diagrammatic view of the apparatus of FIG. 1, with the conveyor, control and drive apparatus removed.

FIGS. 1 and 2 show diagrammatically the preferred embodiment of the apparatus according to the invention. A stacking table 10 for receiving pads 12 is vertically movably positioned below rotating stacker head 14. Index 16 aligns the leading edge 18 of the pads 12 and stacking table 10 is vertically movable with respect thereto. A device for vertically moving the stacking table 10 is referenced by 20. Counter 21 counts individual pads as they are stacked or groups of superposed pads as they are stacked. This may be done directly by counting the pads themselves or indirectly by, for example, counting the number of revolutions of wheel 24 or the number of starts or stops of wheel 24. Other ways will be apparent to those skilled in the art. Conveyor 22 moves the pads towards the stacker head 14.

Stacker head 14 is made up of stacker wheels 24 connected by shaft 26 (FIG. 2). Arcuate clips 28 are affixed to wheels 24 curved outwardly therefrom to receive the leading edge 18 of pads 12. Clip ends 30 are further structured outwardly to cam against the top of stack 34 and to facilitate entry of the leading edges 18 thereunder. By camming against the top of stack 34, clips 28 pinch the leading edge of pad 12 between the vortex portion of clip 28 and wheel 24. This insures that leading edge 18 of pad 12 is pulled up to and against planar surface 48 and prevents bounce-back of the pad. There is normally a tendency of the pad to bounce back which is caused by the high speed operation of the apparatus and the abrupt stop of leading edge 18 against surface 48.

Air nozzle 32 directs a stream of air at the appropriate time to a portion of a pad being stacked approximately along the top of the stack 34 of the pad 12 and will be described more fully hereinafter.

Apparatus for rotating the stacker head 14 is referenced by 36; apparatus for driving the conveyor 22 is referenced by 38; and apparatus for supplying, releasing and interrupting a stream of air through nozzle 32 is referenced by 40. Such apparatuses as well as counter 21 are well known to those skilled in the art and further description is deemed unnecessary herein.

Apparatuses for controlling and synchronizing the rotation of stacker head 14, movement of table 10 and the releasing of a stream of air from nozzle 32 are referenced by 42. Such control apparatuses are well known to those skilled in the art and further description herein is deemed unnecessary. Photo cells 44 (stacker head) and 46 (stacking table) and counter 21 provide sensing information to the control apparatus 42.

Referring especially to FIG. 2, index 16 has a planar surface 48 for aligning the leading edges 18 of pads 12. Slots 50 are positioned at the top of index 16 and are sufficiently wide to permit passage therethrough of wheels 24.

In operation, flexible pads 12, which are relatively large, flat and lightweight, are moved on conveyor 22 in the direction of the arrow towards stacker head 14, as shown in FIG. 1 at A. The pads 12 may be placed on or may reach the conveyor in any known manner. As the leading edge 18 of pad 12 advances towards stacker head 14, it passes between clips 28 and the surface of the wheels 24 and becomes engaged therebetween upon further advance of the leading edge 18, as shown in FIG. 1 at B, with the pad shown broken-away and in phantom. This engagement is sensed by photo cell 44 which communicates this information to system control 42. System control 42, in turn, activates the stacker head drive apparatus 36 and the wheels 24 are caused to commence rotating towards the stacking table (counterclockwise in FIG. 1). As best shown in FIG. 2, the leading edge 18 will strike intermediate portion 52 of index 16 as the wheels 24 rotate. With the continued rotation of wheels 24, intermediate portion 52 will cause pad leading edge 18 to become disengaged from between clips 28 and the surface of wheels 24 while the camming action of the clips maintain the pad leading edge against index 16. Since the surface 48 of index 16 is planar, the leading edge of the last stacked pad will be aligned with those of the previously stacked pads, as shown in FIG. 1 at C, with the pad shown broken-away and in phantom. As the leading edge of the last stacked pad is indexed as described above, a stream of air is released through nozzle 32. The pressure of the air need not be particularly high. The stream of air is directed against the trailing portion of the pad and forms a movable belly therein which assists in taking the pad off wheels 24 and conveyor 22. The belly, as shown at D of FIG. 1, is formed as the stream of air is directed against the pad and the belly moves along the pad as it is stacked. The stream continues to assist in stacking the pad on the top of the stack as the belly moves as shown at E and F of FIG. 1. It will be noticed that the pad leading edge will be rotated approximately 180° and the relative positioning of the pad leading edge top and bottom will be reversed by this rotation. The stream of air assists in completing the reversal of positioning of the remainder of the pad and is then subsequently interrupted.

Wheel 24 continues to rotate until photo cell 44 senses that clip 28 is again in position to receive another pad leading edge and that the previous leading edge has been disengaged. Photo cell 44 communicates this information to system control 42 which causes stacker head drive apparatus 36 to stop rotation of the stacker head.

In order to maintain the top of stack 34 so that the cam portion of clip 38 will perform the aforementioned pinching function, and to maintain the top of the stack approximately level with the bottom 54 of slots 50, the stacking table is vertically movable. Apparatus 20 accomplishes this through control by system control 42 and photo cell 46 in a manner apparent to those skilled in the art. For example, an electric motor and appropriate gearing, in conjunction with appropriate controls, are suitable for vertically adjusting the stacking table. Alternately, and not by way of limitation, a fluid-operated system can be employed.

Counter 21 may be employed where it is desired that each stack be completed having a predetermined number of pads. Counter 21 is preset to the desired number and when the counter reaches the predetermined count, this information is communicated to control 42 which stops the stacking operation. When a predetermined count has been reached, photo cell 46 is bypassed so that the stack table can be repositioned at the proper height. After the completed stack is removed, the operation is resumed. The operation may, of course, be manually started and stopped. Counting may also be accomplished electrically using information from photo cell 46.

Figure 3:
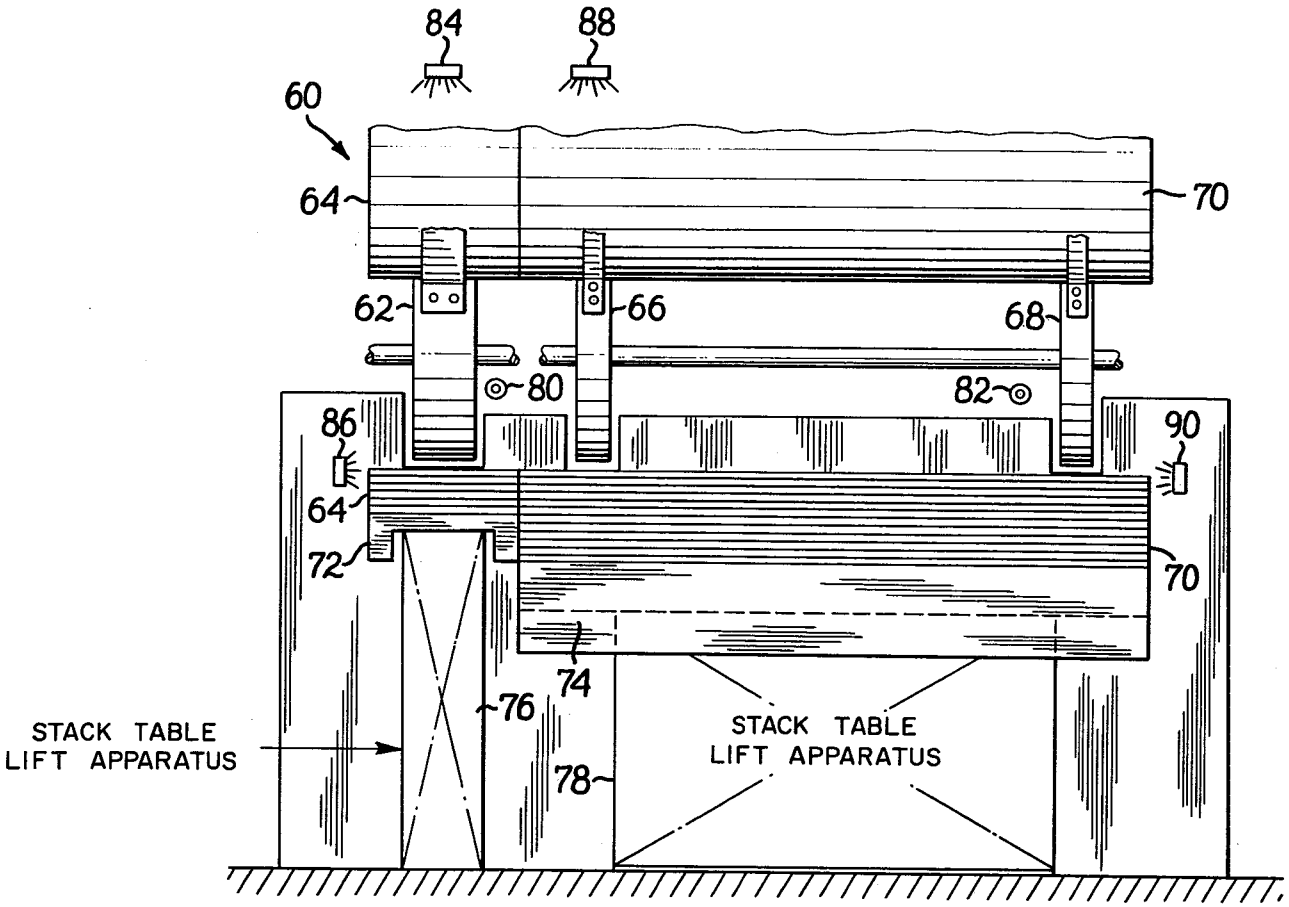
FIG. 3 is a front diagrammatic view of another embodiment of an apparatus according to the invention for simultaneously stacking two pads.

While the disclosed invention has been described with respect to operation with the two wheel preferred embodiment of FIGS. 1 and 2, a single wheel may be advantageously used. In FIG. 1, the width 56 of the wheels 24 has been shown to be relatively small with respect to the width 58 of the pads. A single wheel whose width is a substantial proportion of the width of the pad may be used. Referring to FIG. 3, wheel 62 is a substantial proportion of pad 64. Operation using a single wheel would be similar to that described hereinbefore for two wheels, except that the index comprises a single slot for the single wheel.

In FIG. 3, a stacker 60 shown without control and drive apparatus is shown which is capable of stacking two pads simultaneously. Wheel 62 stacks pads 64 and wheels 66 and 68 stack pads 70. Independent stacking tables 72 and 74 are provided for pads 64 and 70, as well as independent stacking table lift apparatuses 76 and 78. Separate air nozzles 80 and 82 are also provided as well as separate photo cells 84, 86, 88 and 90. The pads 64 and 70 may have been drawn from a common roll (not shown) and cut lengthwise and crosswise to form the two pads. The length of the two pads may be unequal or equal. If equal, independent drive operation of the three wheels 62, 66 and 68 is not required.

Operation of the apparatus shown in FIG. 3 is similar to operation of the pad stacker shown in FIGS. 1 and 2, except that stacking of pads 64 and 70 may proceed independently and without synchronization, i.e., they may be selectively operable. Control and drive apparatus as described hereinbefore are required and will be apparent to those skilled in the art. For example, the use of a plurality of belts or chains in a motor/belt system will permit independent operation and easy adjustment of the apparatus for different width pads.

Operation has been described hereinbefore for simultaneous side-by-side stacking of a plurality of pads. A plurality of superposed pads may also be simultaneously stacked. Referring to FIG. 1, a plurality 91 of superposed pads 12 may be fed towards the stacker head 14. The pads may be superposed by feeding stock from a plurality of rolls of pad material (not shown) to form superposed layers of pad material. The pad layers are fed to a cutting apparatus (not shown) which cuts all the layers simultaneously to form the plurality of superposed pads. Operation with a plurality of superposed pads is similar to that described for a single pad.

The pads need not be stacked on stacking tables and may be stacked directly on a movable system such as the conveyor system shown in FIG. 4. The pads 92 are stacked against index 94 on conveyor 96, as described hereinbefore. Conveyor portion 98 is mounted, on lift apparatus 100. Portion 102 is selectively fixedly mounted. As the stack 104 size increases, portion 98 will move downwards. When portions 98 and 102 are even, the conveyor system is caused to operate and stack 104 will be moved along the conveyor. Photo cell 106 senses the stack height as described hereinbefore. Photo cell 108 senses the time at which the conveyor portions are even and causes them to commence movement. The height of the completed stack can be adjusted by adjusting legs 110 and the height of photo cell 108. Alternatively, a counter as in FIGS. 1 and 5 may be employed to energize the conveyor system to move a stack after a predetermined number of pads has been stacked.

Referring to FIG. 5, another system is shown for stacking pads directly on a conveyor. This system is especially suited for stacking pads into units of about 15 inches or less. Conveyor portion 102 is similar to that shown in FIG. 4. End 112 of conveyor portion 114 positioned away from index 94 is pivot mounted and end 116 is mounted on lift apparatus 118. Conveyor portion 102 is fixed at a level even with pivoted end 112 of conveyor portion 114. As pads are stacked on conveyor portion 114, end 116 is moved vertically. The top of the stack 120 is kept at the same position with respect to index 94 by photo cell 106 in conjunction with the lift apparatus 118. When a stack of predetermined number has been reached by counting as described hereinbefore, photo cell 106 is bypassed, stack 120 is caused to move on the conveyor, and end 116 is caused to revert to its original position to again be controlled by the photo cell.

Wheels 24 with clips 28 have been disclosed for receiving and securing the pad leading edge and rotating it 180°. However, a drum or other devices with clips or other spring means mounted thereon can receive, secure and rotate a pad edge. For example, the particular structure need not be that of a wheel or drum, and may comprise single pivotable members having means thereon to engage the pad. Such devices will be apparent to those skilled in the art. If a drum is employed, the slot in the guide must be wide enough to allow the drum to pass therethrough and the guide must be wider than the pad so that the pad will strike the guide as the drum passes through the slot. The use of a drum is similar in operation to the use of wheel 62 in FIG. 3.

Referring to FIG. 6, wheel 122 of a stacker head is shown with a pair of clips **28*a* and 28*b* positioned approximately 180° apart. As described hereinbefore, rotation of wheel 24 is stopped after a pad leading edge has been indexed and the wheel has rotated so that clip 28 is again in position to receive the next pad. When using a second clip on wheel 122, rotation of the wheel is stopped after a pad, engaged by clip 28*a*, has been indexed and when the opposite clip 28*b*** is in position to receive the next pad. This arrangement eliminates a half-cycle of unnecessary motion for each pad stacked. The presence of the extra clip does not hinder stacking and in fact assists in that the unengaged clip, being in position between a pad remainder and a wheel surface, assists in taking the pad remainder off the wheel.

Although it has been disclosed that conveyor 22 in FIG. 1 is operating continuously, the conveyor could be operated intermittently and synchronized to the system operation. For example, conveyor 22 can be made to start and stop so that a pad leading edge 18 reaches clip 28 at precisely the right time. Apparatus for accomplishing this will be apparent to those skilled in the art. The photo cells have been disclosed to sense position of the clips, height of the stack, and the indexing of a pad against the index. Other means may provide this information and will be apparent to those skilled in the art. For example, a pressure-sensitive switch could sense the leading edge 18 instead of a photo cell. Such a switch could be incorporated into the clips or placed on the surface of the wheels or incorporated into the conveyor. Similarly, a weight sensitive device such as a spring could obviate the need for the photo cell which senses the stack height.

The control of the various stacking tables need not be by closed loop means. For example, the movement of the stacking tables may be through a weight sensitive device such as a spring. Where an open loop weight-sensitive means is employed, the weight of the pads must be considered. Open loop control may also be achieved through a counting device wherein the table is moved a predetermined distance for each pad counted.

While the guide and stacker head are shown to be vertically fixed and the stacking table vertically movable, the opposite may be done and still maintain the stack in the proper relative position.

Similarly, controlling the releasing of air and the rotation of the pads need not be through closed loop system. For example, a timing device may be used to control these operations. In such a case, the pad dimensions and rate of rotation of the pad must be considered.

Other open loop systems will be apparent to those skilled in the art.

When more than one pad is simultaneously stacked, the pad dimensions need not be the same. In such a case, the essential different operations are controlled independently.

Apparatuses other than the disclosed conveyor could deliver the pads to the stacker head, or the stacker head could be fed by hand. Other such apparatuses will be apparent to those skilled in the art.

Although a stream of air assists the pad remainder to follow the pad leading edge in reversing its position, other means may be used to accomplish this. For example, one or more synchronized arms or members may be used acting approximately along the axis of the released stream of air or along other axes. Or a vacuum or suction acting opposite to the released stream of air may be used. Or air may be released from a direction other than the one shown. Other means will be apparent to those skilled in the art from the foregoing.

Although the precise details of various stacking table lift apparatus have not been described, such apparatus may comprise a hydraulic device, or an electric motor as mentioned hereinabove, or other devices apparent to those skilled in the art. Similarly, details of the system control, the stacker head drive apparatus, and the conveyor drive apparatus will be apparent to those skilled in the art.

The advantages of the present invention, as well as certain changes and modifications of the disclosed embodiment thereof, will be readily apparent to those skilled in the art. It is the applicant's intention to cover all those changes and modifications by his claims which could be made to the embodiment of the invention herein chosen for the purposes of the disclosure without departing from the spirit and scope of the invention.

I claim:

1. A method for stacking flexible pads of low density fibrous materials in at least one aligned stack, which comprises the steps of:

a. receiving and securing the leading edge of at least one pad to be stacked above said at least one stack near one end thereof;

b. rotating said leading edge approximately 180° reversing the relative positioning of the top and bottom of the leading edge and forming a belly in said pad;

c. holding said reverse positioned leading edge at the top of said at least one stack against an index indexing at the said one end thereof;

d. directing an air stream into the said belly thereby assisting the portion of the pad trailing said leading edge to reverse its upper and lower positions along and on said at least one stack; and e. terminating the holding of said leading edge.

2. Method according to claim 1 further comprising the step of automatically moving completed stacks of predetermined size away from said index.

3. Method according to claim 1, wherein the pads are stacked one at a time into a single stack.

4. Method according to claim 1, wherein a plurality of pads are simultaneously stacked into a single stack.

5. Method according to claim 1, wherein a plurality of pads are simultaneously stacked into a plurality of stacks.

6. Method according to claim 5, wherein the pads of each stack are of the same size.

7. Method according to claim 5, wherein the pads of at least two stacks are of different size.

8. Method according to claim 1, wherein said step of holding said leading edge further comprises:

a. engaging said leading edge between a wheel and a spring;

b. rotating said wheel and spring; and c. camming said spring against the upper pad on said stack whereby additional holding force is applied to said leading edge.

9. Apparatus for stacking flexible pads of low density fibrous materials in at least one aligned stack, which comprises:

a. receiving means for receiving and securing the leading edge of at least one pad to be stacked above said at least one stack near one end thereof;

b. rotating means for rotating said leading edge approximately 180° reversing the relative positioning of its top and bottom;

c. an index;

d. means for placing said leading edge against said index;

e. means for temporarily holding said leading edge against said index; and f. air jet means for assisting the portion of the pad trailing said leading edge to reverse its upper and lower positions along and on said at least one stack.

10. Apparatus according to claim 9 further comprising removing means for automatically moving a completed stack of predetermined size away from said discharging means.

11. Apparatus according to claim 10 wherein the predetermined size is established by pad count.

12. Apparatus according to claim 10 wherein the predetermined size is established by stack height.

13. Apparatus according to claim 9 wherein said rotating means comprises at least one rotatably mounted member.

14. Apparatus according to claim 13 wherein said temporary holding means comprises spring means positioned on said at least one rotatably mounted member operative to receive and releasably secure said leading edge on and to said at least one rotatably mounted member.

15. Apparatus according to claim 14 wherein said at least one rotatably mounted member comprises a wheel.

16. Apparatus according to claim 14 wherein said spring means comprises a V-shaped clip associated with each of said at least one rotatably mounted member formed by a surface of said at least one rotatably mounted member and a flexible member secured at one end thereof thereon.

17. Apparatus according to claim 16 wherein said flexible member is arcuate and curved to form a portion of said V-shaped clip.

18. Apparatus according to claim 17 wherein the opposite end of said flexible member is further curved than the remainder of said arcuate flexible member in a direction away from said surface.

19. Apparatus according to claim 8 wherein said index comprises a fixed member having a planar surface positioned to contact at least a portion of said leading edge after it is rotated approximately 180°.

20. Apparatus according to claim 14 wherein said index comprises a fixed member having a planar surface positioned to contact at least a portion of said leading edge after it is rotated approximately 180°.

21. Apparatus according to claim 20 wherein said fixed member further comprises at least one slot to permit passage of said spring means therethrough when said rotatably mounted member is rotated.

22. Apparatus according to claim 9 further comprising feed means for feeding said at least one pad towards said receiving means.

23. Apparatus according to claim 21 further comprising means for vertically moving said at least one stack to maintain the top thereof approximately level with the bottom of said at least one slot.

24. Apparatus according to claim 23 further comprising at least one table for stacking pads thereon and a device operative to vertically move said at least one stack and table.

25. Apparatus according to claim 9 further comprising automatic height means to automatically move said at least one stack away when said at least one stack reaches a predetermined height.

26. Apparatus according to claim 24 further comprising automatic height means to automatically move said at least one stack away when said at least one stack reaches a predetermined height.

27. Apparatus according to claim 25 wherein said automatic height means comprises photo-electric means.

28. Apparatus according to claim 26 wherein said automatic height means comprises photo-electric means.

29. Apparatus according to claim 9 further comprising automatic counting means to count the number of pads being stacked in said at least one stack.

30. Apparatus according to claim 23 further comprising automatic counting means to count the number of pads being stacked in said at least one stack.

31. Apparatus according to claim 29 further comprising removing means cooperating with said counting means for automatically moving a completed stack of predetermined number away.

32. Apparatus according to claim 30 further comprising removing means cooperating with said counting means for automatically moving a completed stack of predetermined number away.

33. Apparatus according to claim 18 wherein said opposite end is adapted to camming against the surface of said at least one stack whereby said leading edge is temporarily squeezed between said flexible member and said rotatably mounted member.

* * * * *